United States Patent [19]

Jacobson

[11] Patent Number: 4,608,495

[45] **Date of Patent: * Aug. 26, 1986**

[54] COLLAPSIBLE RADIATION ATTENUATION SYSTEM

[76] Inventor: Earl B. Jacobson, 510 S. Share Dr., Crystal Lake, Ill. 60014

[ * ] Notice: The portion of the term of this patent subsequent to Aug. 23, 2000 has been disclaimed.

[21] Appl. No.: 553,820

[22] Filed: Nov. 21, 1983

[51] Int. Cl.[4] ..... G21F 3/04

[52] U.S. Cl. ..... 250/517.1; 250/519.1

[58] Field of Search ..... 250/517.1, 519.1

[56] References Cited

U.S. PATENT DOCUMENTS 4,362,948 12/1982 Weissenfluh ..... 250/517.1

4,400,623 8/1983 Jacobson ..... 250/517.1

*Primary Examiner*—Sam Silverberg

*Attorney, Agent, or Firm*—Silverman, Cass, Singer & Winburn, Ltd.

[57] ABSTRACT

A portable self-supporting collapsible modular radiation attenuation system formed from a plurality of modules secured to one another in any desired alignment to protect workers from radiation exposure. The modules are skins assembled and shaped to mate with one another when secured thereto, such as by clip means. The skins are attached together and include a bladder which is filled with a radiation attenuating fluid. The modules mate with one another to eliminate radiation paths between the assembled modules. The modules are drained, disassembled and collapsed for storage. Also, an integral bladder can be included as a radaition plug.

28 Claims, 15 Drawing Figures

COLLAPSIBLE RADIATION ATTENUATION SYSTEM

BACKGROUND OF THE INVENTION

The invention relates generally to radiation attenuation systems and more particularly to a collapsible modular radiation attenuation system. The system is designed to be temporarily assembled in any desired location and alignment and then filled with radiation attenuating fluid and then drained and stored in a collapsed, i.e. spaced saving configuration.

In nuclear power plants and in dealing with radiation wastes in general, it is desirable to be able to place a portable shielding system in place with a minimum of exposure to the workers in putting the attenuation system in place, have a maximum radiation attenuation in the system as well as ease in utilizing the system.

Each worker in a radiation emitting environment typically is attired in protective clothing; however, shielding is desired when the workers have to be in a radiation area for any length of time. Further the amount of exposure to each worker should be as small as possible. In a radiation area this has typically been accomplished by controlling the time of exposure and the proximity of each worker to the radiation source. Shielding influences the amount of exposure in a time period by altering the radiation environment. The shielding decreases the amount of radiation to which each worker is exposed in a time period.

Attempts to reduce the radiation exposure, such as around a reactor head during refueling operations or in waste removal, have been made such as by placing lead shielding around the radiation source or providing a frame with balloon or bag type constructions which are then filled with water. Some attempts have also been made to provide large hollow shells which are then filled with a radiation attenuation fluid. These non-integrated systems have several disadvantages including exposure between the lead members or bags. These prior art units are cumbersome to work with, generally are not free standing and are not easily adaptable to the irregular work spaces which often exist in the radiation environment.

A much improved modular radiation attenuation system is disclosed in Applicant's U.S. Pat. No. 4,400,623, entitled Radiation Attenuation System. This integrated system provides a number of improvements over other prior systems; however, since the modules are not collapsible, the system does involve a considerable amount of storage space. Where storage space is critical, it would thus be desirable to have a integral system for storage which is collapsible and has the benefits attained by the nesting configurations disclosed in U.S. Pat. No. 4,400,623.

SUMMARY OF THE INVENTION

The above and other disadvantages of prior art radiation attenuation systems and techniques are overcome in accordance with the present invention by providing a self-supporting collapsible modular radiation attenuation system which easily can be assembled in any desired configuration between the radiation source and the work area. The system is formed from a plurality of radiation attenuation modules which are shaped to conform with adjacent modules when assembled and secured to one another in the desired alignment. The modules are formed from an outer shell or skin, attaching or mating means and an internal bladder. Once assembled the modules are filled with a radiation attenuating fluid. When the system is to be stored, the modules are drained, disassembled and then can be collapsed into a generally flat, space saving configuration.

DESCRIPTION OF THE PREFERRED EMBODIMENTS

Figure 1:
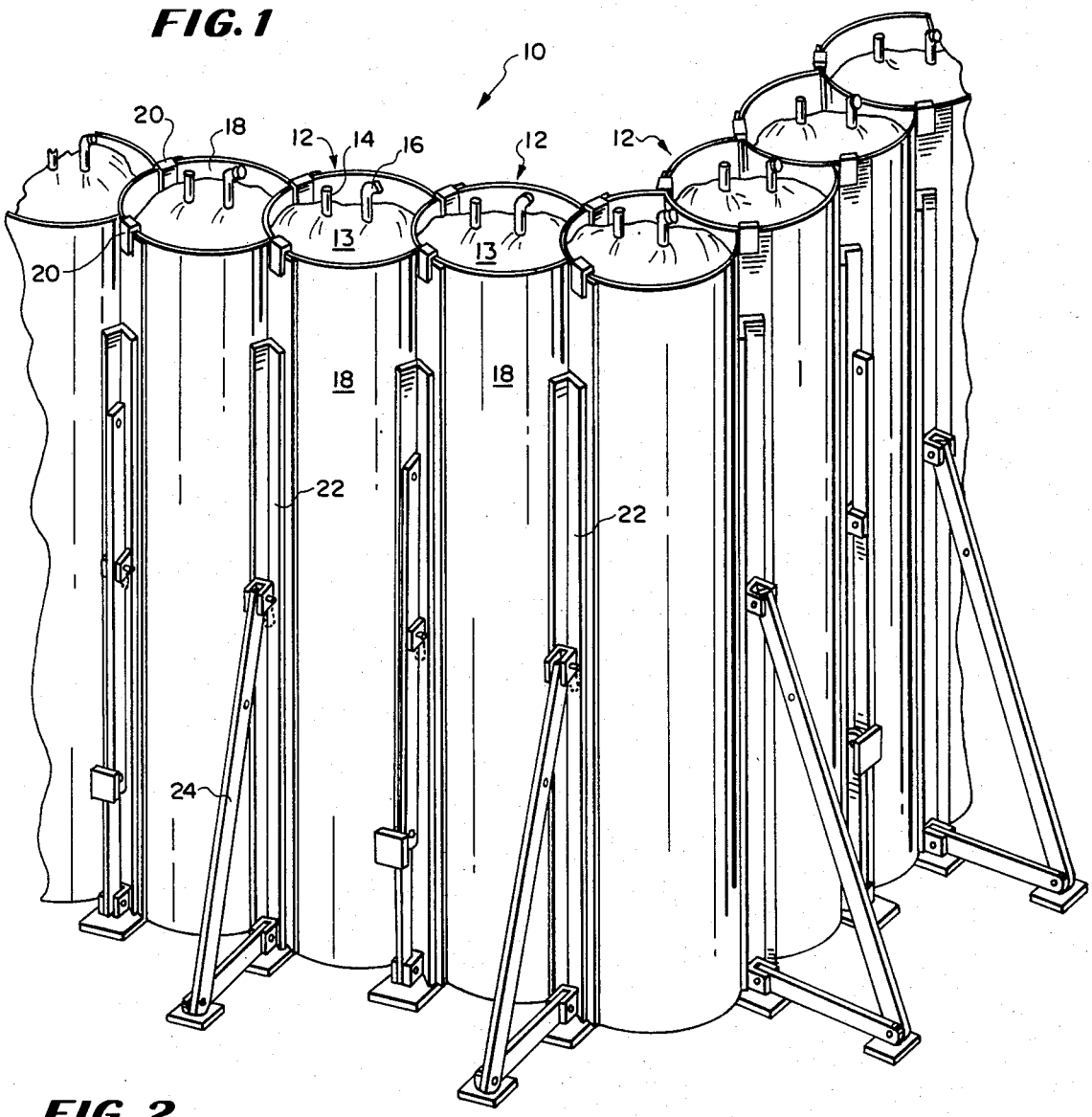
FIG. 1 is a partial perspective view of one assembled embodiment of the collapsible modular radiation attenuation system of the invention.

Referring to FIG. 1, an assembled collapsible modular radiation attenuation system embodying the invention is designated generally by the reference numeral 10. The collapsible modular radiation attenuation system or radiation attenuator 10 is shown assembled in an angular configuration and includes a plurality of modules 12. Each module 12 generally includes a bladder 13 with at least two ports 14 and 16 which are utilized to fill and empty the modules 12 with radiation attenuating fluid. Each module 12 includes a container, skin or shell 18 which is assembled to conform to the shell 18 of an adjacent module.

Each module 12 includes a pair of top clips or other attaching means 20 and a frame 22, which are secured to the adjacent module 12 to assemble the radiation attenuator 10. Once the modules 12 are assembled with their respective clips 20 and frames 22 in the desired alignment, between the work space and the source of radiation, each of the bladders 13 of the containers 18 can be filled. The bladders 13 can be filled through the ports 14 and 16, which can be coupled together in a manifold type system with the filling and emptying done from a remote position.

Figure 7A:
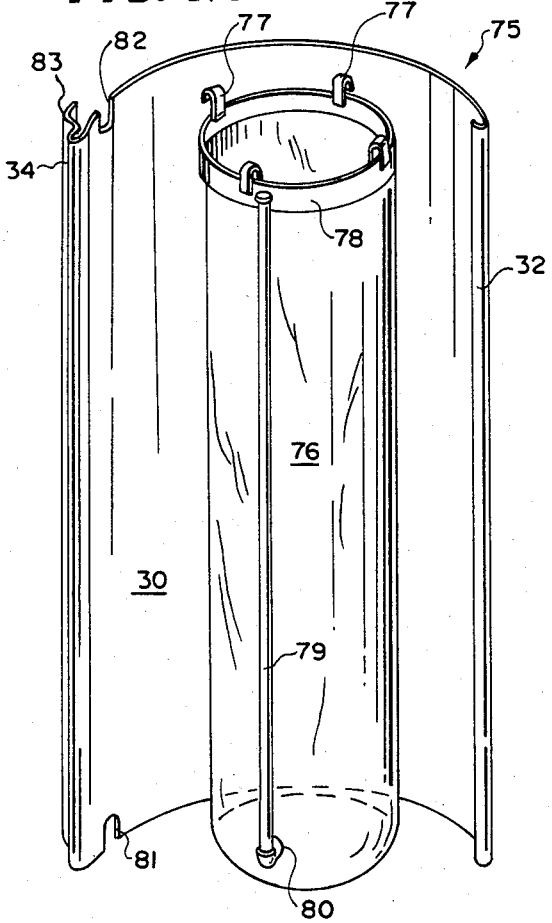
FIG. 7A is a perspective view of one partially assembled module embodiment of the radiation attenuation system of the invention.

One or more of the skins 18 also can include a semi-transparent strip which can be monitored to make sure the system 10 is completely filled with fluid. Alternately, an external level indicating tube or device can be utilized, as illustrated in FIG. 7A. The fluid can contain a coloring agent to assist in visually determining the fluid level in the system.

Each frame 22 preferably includes a collapsible leg or brace 24 which can be unfolded to provide the desired support for the assembled attenuator 10. The frame 22 maintains the skin edges in position and prevents bulging of the skin 18 along the edges thereof. If the radiation attenuator 10 is aligned in one or more bends or otherwise is aligned in other than a substantially straight line the legs or braces 24 can remain folded.

Figure 2:
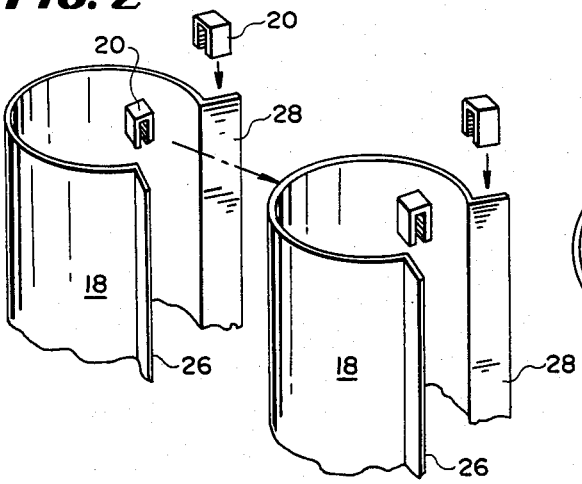
FIG. 2 is an exploded perspective view of a portion of the attenuation system of FIG. 1.
Figure 3:
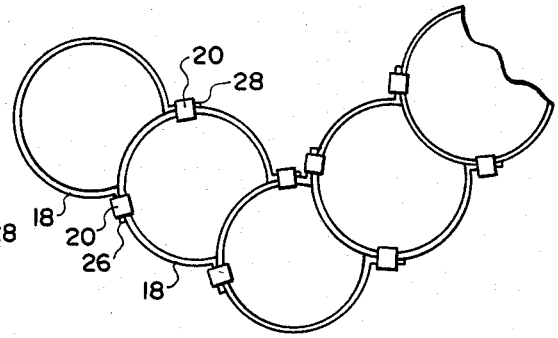
FIG. 3 is a top view of a portion of the attenuation system of FIG. 1.

The skin 18 and retaining means 20 are best illustrated in FIGS. 2 and 3. Each of the skins 18 includes a pair of outwardly oriented flanges 26 and 28. In assembling the modules 12, the skins 18 are aligned in the desired configuration and then the clips 20 are secured to the top edges of the flanges 26 and 28 and the frames 22 support the sides and bottom of the flanges 26 and 28 to maintain the alignment. One or a plurality of the modules 12 can then be moved into the radiation area, before or after the bladders 13 are inserted. The bladders 13 then are filled with the attenuation fluid.

Figure 4:
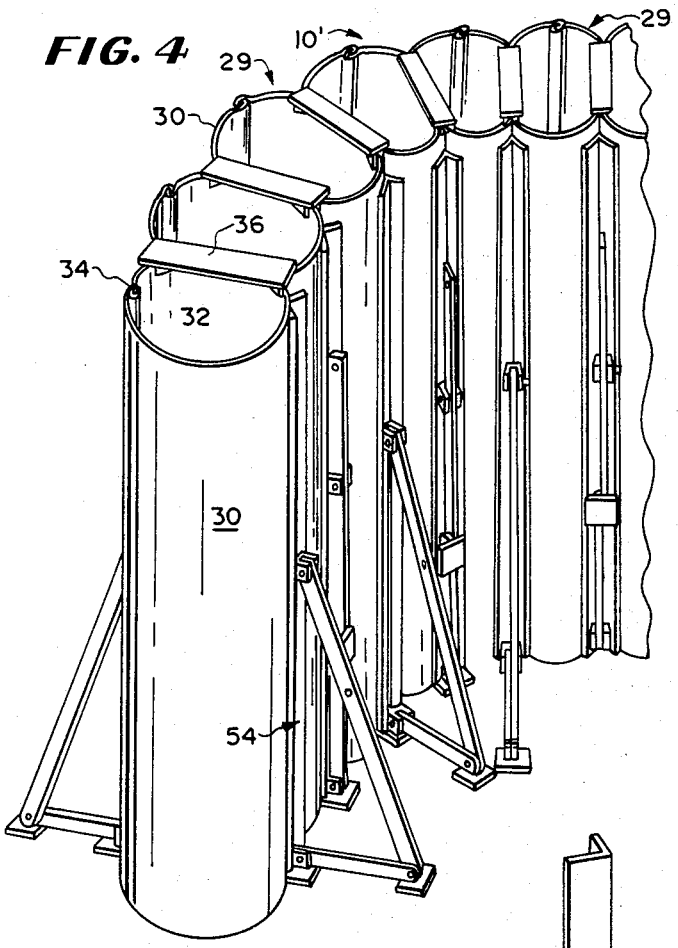
FIG. 4 is a perspective view of a second assembled embodiment of the modular radiation attenuation system of the invention.
Figure 5:
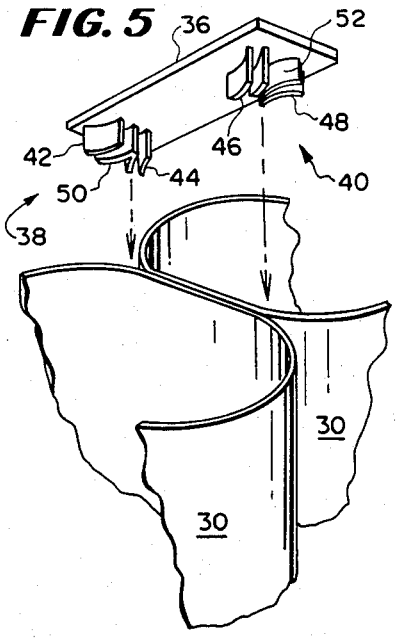
FIG. 5 is a partial top sectional view of the system of FIG. 4 illustrating one embodiment of module securing means.
Figure 6:
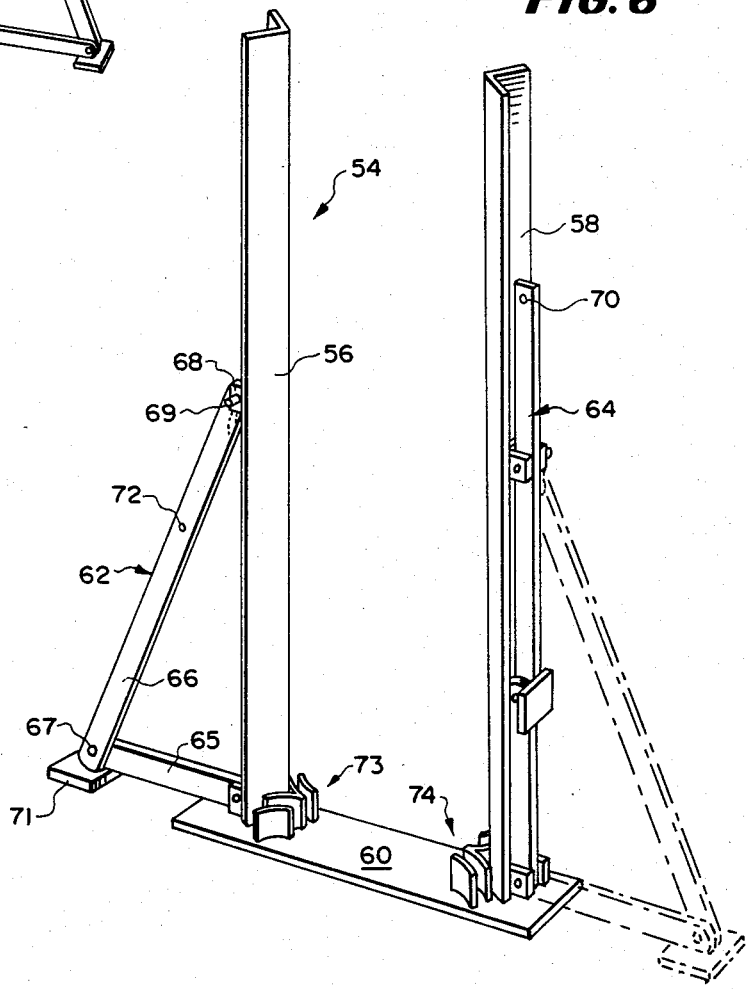
FIG. 6 is a perspective view of one support means of the system of FIG. 4.

FIGS. 4–6 illustrate another embodiment 10′ of the system of the invention with a plurality of modules 29. In the attenuator system 10′, a skin or shell 30 includes a pair of interlocking mating edges or flanges 32 and 34 which are assembled together to form a generally cylindrical shell. The shells 30 are maintained in their assembled configuration by a top clip piece 36 which has a pair of oppositely configured support assemblies 38 and 40. Each support assembly 38 and 40 has a respective pair of outer support flanges 42, 44, 46, 48 and a respective center flange 50 and 52. The outer flanges are positioned inside the adjacent skins 30 with the center flanges 50 and 52 between the adjacent skins to easily assemble the module tops of the system 10′.

The bottoms and sides of the skins 30 are supported by a frame 54 best illustrated in FIG. 6. The frame 54 includes a pair of support posts 56 and 58 to support the sides of the shells 30. The frame 54 also includes a bottom plate or bar 60, to which the posts 56 and 58 are mounted. The posts 56 and 58 each preferably support respective foldable legs or braces 62 and 64. Only one brace 62 will be described in detail, since each of the legs or braces 24, 62 and 64 are substantially identical. The brace 62 includes a first arm 65 and a second arm 66 pivotably connected thereto, such as by a pin assembly 67. The post 56 includes a U-shaped bracket 68 through which a retaining pin 69 is secured through a first aperture 70 (see brace 64) when the brace 62 is in the supporting position illustrated.

Each of the braces also preferably includes a stabilizing plate 71. The brace 62 includes a second aperture 72, through which the pin 69 is secured when the brace is in the collapsed position (see brace 64). The frame 54 also includes a pair of oppositely configured support assemblies 73 and 74, which function to hold the bottoms of the shells 30 in a manner similar to the top assemblies 38 and 40. The posts 56 and 58 can replace the center support flanges. In the assembled system 10′, each of the modules 29 provide additional support for the adjacent modules, with or without the braces.

Figure 7B:
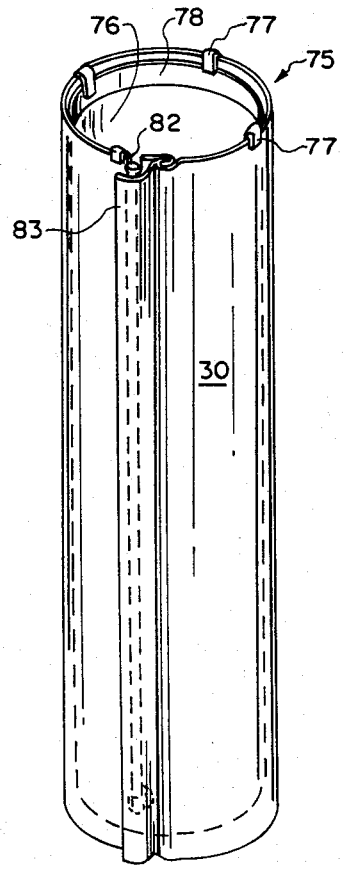
FIG. 7B is an assembled perspective view of the module of FIG. 7A.

FIGS. 7A and 7B illustrate one module embodiment 75 of the system 10′, partially and totally assembled. The skin 30 and the flanged edges 32 and 34 are illustrated unassembled in FIG. 7A with a bladder 76 therein. The bladder 76 includes a plurality of hooks 77 at an upper, preferably reinforced, edge 78 thereof. The hooks 77 are placed over the edges of the skin 30 to secure the bladder 76 in place, which can then be an open ended bladder. The bladders, such as the bladder 76, can include a liquid level indicating tube or visual strip 79. The tube 79 can be connected at a lower end 80 to the interior of the bladder 76. The skin 30 can include a bottom slot 81 which accomodates the tube 79. The skin 30 can include a top slot 82 to which the tube 79 is affixed or secured. The edge 34 of the skin 30 also preferably includes a protective flange 83 which extends outwardly to accomodate and protect the tube 79.

Figure 8:
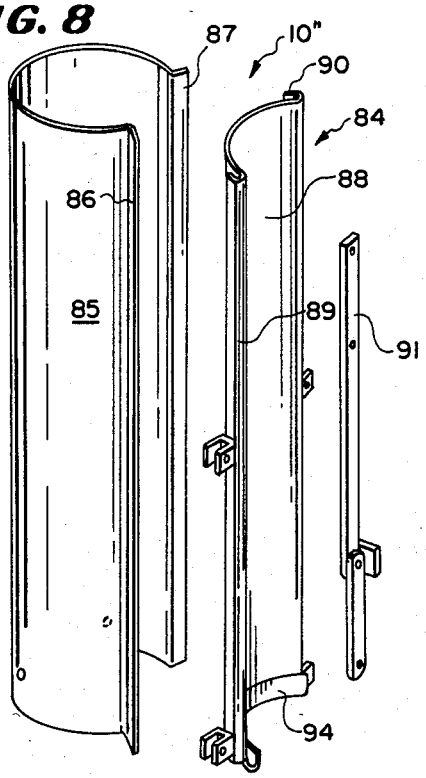
FIG. 8 is a partial perspective view of another partially assembled module embodiment of the radiation attenuation system of the invention.
Figure 9:
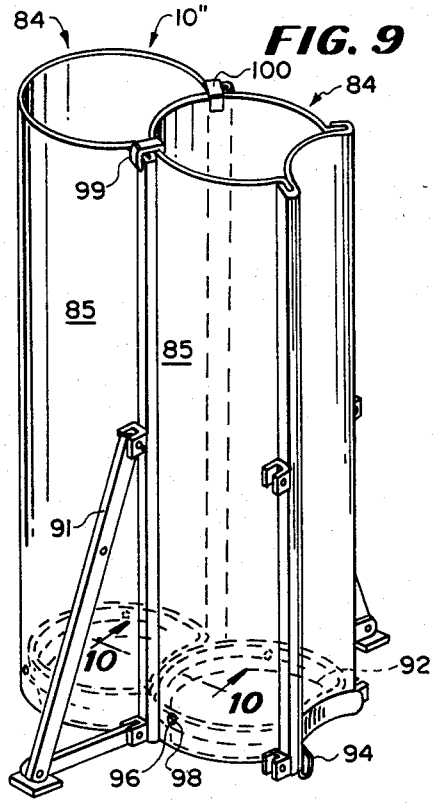
FIG. 9 is an assembled perspective view of a pair of the modules of FIG. 8.

FIGS. 8 and 9 show one preferred embodiment 10″ of the attenuation system of the invention. The system includes a module 84 which is formed from a skin 85 (similar to the skin 18) which has a pair of outwardly extending flanges 86 and 87. A mating plate 88 has a pair of inwardly turned flanges 89 and 90. The flanges 89 and 90 interlock with the flanges 86 and 87 to provide a rigid skin for the modules 84. A bladder (not illustrated) as previously described can then be inserted into the assembled module skin. Frames (not illustrated) can be provided for support if desired; however, the plate 88 can have sufficient rigidity to eliminate the frames. Support legs or braces 91 also can be added to the flanges 89 and 90 if desired.

Figure 10:
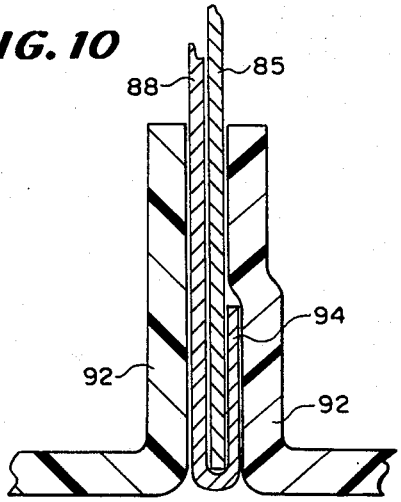
FIG. 10 is a partial side sectional view of the modules of FIG. 9 taken along the line 10—10 therein.

The module 84 preferably also includes a retaining pan 92 which serves to protect the bladder inside the module 84 and also to maintain the ridgidity of the system 10″. The mating plate 88 also preferably includes a bottom assembly flange 94 and/or a top assembly flange (not illustrated), which mates with the adjacent skin 85 as illustrated in FIGS. 9 and 10.

The retaining pan 92 is configured to fit inside the engaged skin 85, the mating plate 88 and the flange 94. The pan 92 also preferably includes outwardly extending nubs or pins 96 which snap into holes or indentations 98 (FIG. 9) in the skins 85. In this manner the pan 92, skin 85 and the mating plate 88 form an integral unit. The modules 84 also preferably include clip means 99 and 100 to secure the tops of the adjacent modules together.

Figure 11:
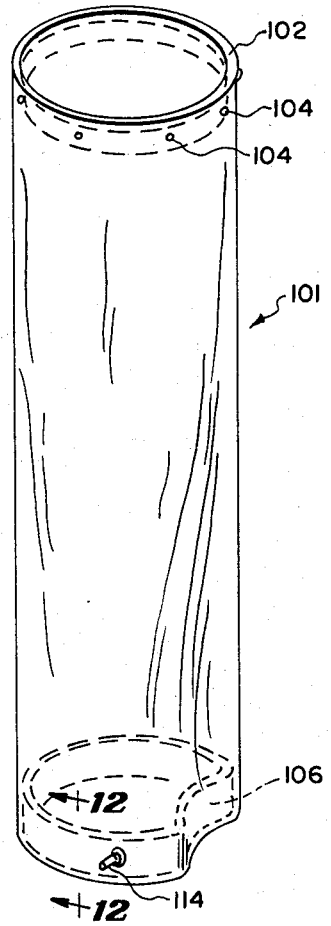
FIG. 11 is a perspective view of one bladder embodiment of the modular radiation attenuation system of the invention.
Figure 12:
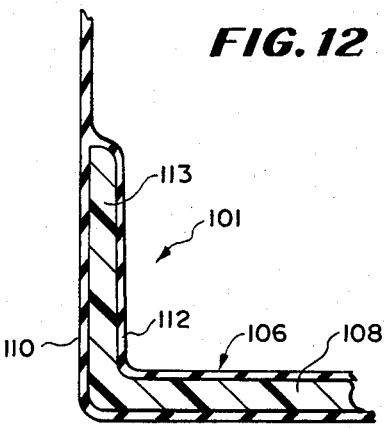
FIG. 12 is a partial side sectional view of the module of FIG. 11 taken along the line 12—12 therein.

One bladder embodiment 101 is best illustrated in FIGS. 11 and 12. The bladder 101 preferably includes an upper support ring 102 which includes snaps 104 or other retaining means which mate with mating snaps or slots (not illustrated) in the skins 18, 30 or 85. The bladder 101 can be utilized without any bottom support, such as the pan 92, as it preferably includes an internal reinforced bottom plate 106. This can be a plastic or other rigid member 108 which is sealed between an outer wall 110 and an inner wall 112 of the bladder 101. The member 108 can be a flat plate, but preferably includes an upstanding wall 113. The bladder 101 also, preferably includes a drain nozzle 114 which is supported in the wall 113 of the bottom plate 106 and extends through the skin.

Figure 13:
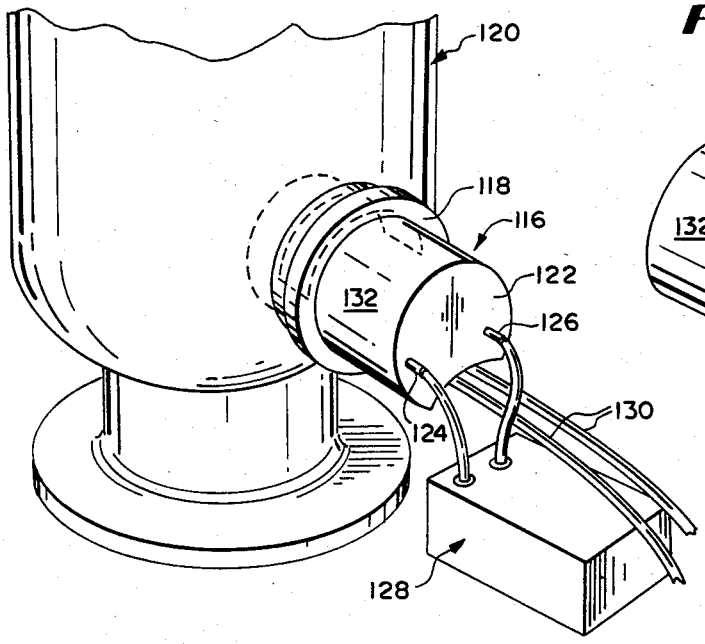
FIG. 13 is a partial perspective view of a module embodiment of the invention utilized to seal a manway or portal in a steam generator.
Figure 14:
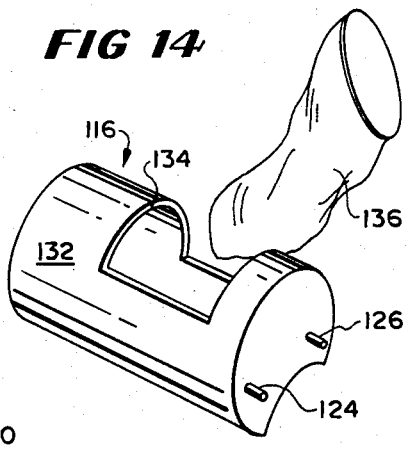
FIG. 14 is a perspective view of one embodiment of the module of FIG. 13.

FIGS. 13 and 14 illustrate a module 116 which is utilized to seal a manway or portal 118, such as in a nuclear power steam generator 120. The module 116 preferably includes a bottom retaining pan or wall 122 which includes an inlet 124 and an outlet 126 for filling the module 116. The inlet 124 and the outlet 126 preferably are connected to a contained automatic filling and draining system 128, which includes high volume pumping means.

The module 116 preferably is configured to allow access for supply and power lines 130 into the generator 120. The configuration can be provided by a mating plate similar to the plate 88. The module 116 preferably has a skin 132 which can include an opening 134 into which a bladder 136 can be inserted. The bladder 136 can be connected to or can include the inlet 124 and the outlet 126. The module 116 also can be a unitary module unit formed from aluminum or other light weight material, which can be a unitary disposable unit which does not contain a bladder.

Many modifications and variations of the present invention are possible in light of the above teachings. The skin can be formed from any flexible, yet substantially rigid material which can support the attenuation fluid, but can be collapsed for easy storage. The skins can be light weight metal, for example, or other sheeting having sufficient strength. The bladder can be formed out of numerous impervious materials, such as 30 mil pvc, reinforced pvc or nylon, fiberglass, rubber or laminates of the materials, such as reinforced, rubberized or plasticized cloth. The modules can be partially or fully assembled outside of the radiation area. The modules can be designed for any desired height and width, although a typical minimum attenuation depth of 12 inches is desired. The bladders can have open or closed tops and can include spiggots or other drains. It is therefore, to be understood that within the scope of the appended claims, the invention may be practiced otherwise than as specifically described.

What is claimed and desired to be secured by Letters Patent of the United States is:

1. A collapsible radiation attenuation system comprising:

a plurality of radiation attenuation module means, each adapted to be substantially filled with a radiation attenuating fluid when positioned where desired;

each of said module means including outer collapsible skin means, skin securing means and bladder means;

each of said module means including means shaped to conform with a substantial portion of the adjacent module means when assembled for substantially eliminating any direct radiation paths between assembled module means; and each of said module means including assembly means adapted for securing said module means to one another in any desired alignment.

2. The radiation attenuation system according to claim 1 wherein:

at least one of said module means includes means for indicating the fluid level in said module means.

3. The radiation attenuation system according to claim 1 wherein:

said module means include an elongated body which includes a concave surface on a portion of said body and a conforming convex surface on a second portion of said body.

4. The radiation attenuation system according to claim 1 wherein:

said module means include port means for filling and removing fluid from said module means.

5. The radiation attenuation system according to claim 4 wherein:

said port means include means for substantially completely filling and substantially completely emptying said module means.

6. The radiation attenuation system according to claim 1 wherein:

said conforming means include outward oriented flanges for conforming with a substantial portion of the adjacent module means when assembled for substantially eliminating any direct radiation paths between assembled module means.

7. The radiation attenuation system according to claim 1 wherein:

said assembly means include clip means for clipping said adjacent module means together.

8. The radiation attenuation system according to claim 1 wherein:

said assembly means include frame means for maintaining the edges of said skin means in position and preventing bulging thereof.

9. The radiation attenuation system according to claim 8 wherein:

said frame means include at least one collapsible brace means for additional support.

10. The radiation attenuation system according to claim 1 wherein:

said skin means include interlocking edges which, when interlocked, form said skin means into a generally cylindrical shape.

11. The radiation attenuation system according to claim 10 wherein:

said assembly means include clip means for securing said module means to adjacent module means.

12. The radiation attenuation system according to claim 10 wherein:

said assembly means include frame means for supporting the sides of said skin means.

13. The radiation attenuation system according to claim 1 wherein:

said bladder means include a plurality of means for securing said bladder means in place within said skin means.

14. The radiation attenuation system according to claim 13 wherein:

said securing means are attached at an upper, open end of said bladder means.

15. The radiation attenuation system according to claim 1 wherein:

said conforming means includes a pair of outwardly extending flanges on said skin means and a mating plate with inwardly turned flanges which interlock with said outwardly extending flanges to conform with a substantial portion of the adjacent module means when assembled for substantially eliminating any direct radiation path between assembled module means.

16. The radiation attenuation system according to claim 15 wherein:

said module means include means for protecting said bladder means and contributing to the rigidity of said system.

17. The radiation attenuation system according to claim 15 wherein:

said mating plate includes at least one assembly flange for mating with the adjacent skin means and contributing to the rigidity of said system.

18. The radiation attenuation system according to claim 1 wherein:

at least one of said module means is adapted to be placed into a nuclear power steam generator for sealing a manway or portal in said generator against radiation leakage.

19. The radiation attenuation system according to claim 18 wherein:

said module means include port means for adding and removing fluid to and from said module means.

20. A radiation attenuation module comprising:

a substantially elongated hollow container body;

means to hold fluid in said container body which includes flexible bladder means and means to secure said bladder to said container body; and said container body having an outer conformation to substantially mate with another container body so when assembled substantially eliminates any direct radiation paths between assembled container bodies; and means to secure said container body to another container body.

21. The module according to claim 20 wherein:

said container body is an integral unit adapted to hold said fluid therein and having means for filling and removing fluid from said body.

22. The module according to claim 20 wherein:

said container body is collapsible and is formed from a sheet which is secured to an adjacent sheet to form said body.

23. The module according to claim 20 wherein:

said container body is collapsible and is formed from a sheet which includes a flange on each of two edges which interlock with one another to form said body.

24. The module according to claim 20 wherein:

said container body is collapsible and is formed from a sheet which includes a flange on each of two edges which interlock with a mating plate having flanges on outer edges thereof, said mating plate having said mating conformation.

25. The module according to claim 20 including:

collapsible brace means to support said container body.

26. The module according to claim 26 wherein:

said brace means are formed integrally with said container body.

27. The module according to claim 20 wherein:

said bladder means include means for filling and drawing fluid therefrom.

28. The module according to claim 20 wherein:

said bladder means include means for indicating the fluid level in said bladder means.

* * * * *